US006109016A

United States Patent [19]

Geirhos

[11] Patent Number: 6,109,016

[45] Date of Patent: Aug. 29, 2000

[54] LOW-SHRINKAGE HYBRID YARNS PRODUCTION THEREOF AND USE THEREOF

[75] Inventor: Josef Geirhos, Bobingen, Germany

[73] Assignee: Hoechst Trevira GmbH & Co. KG, Germany

[21] Appl. No.: 09/173,382

[22] Filed: Oct. 15, 1998

Related U.S. Application Data

[62] Division of application No. 08/835,262, Apr. 8, 1997, Pat. No. 5,879,800.

[30] Foreign Application Priority Data

Apr. 9, 1996 [DE] Germany ..... 196 13 965

[51] Int. Cl.[7] ..... D01H 7/46

[52] U.S. Cl. ..... 57/290; 57/285; 57/351; 57/908; 28/247

[58] Field of Search ..... 57/290, 285, 350, 57/351, 90, 908; 28/247, 271

[56] References Cited

U.S. PATENT DOCUMENTS

| | | | |
|---|---|---|---|
| 3,423,809 | 1/1969 | Schmitt | 28/271 |
| 4,338,776 | 7/1982 | Krenzer | 28/271 |
| 4,574,578 | 3/1986 | Scott | 57/290 |
| 5,100,729 | 3/1992 | Jacob et al. | 428/370 |
| 5,344,710 | 9/1994 | Jacob et al. | 428/370 |
| 5,359,759 | 11/1994 | Jacob et al. | 28/271 |
| 5,399,400 | 3/1995 | Nile et al. | 428/370 |
| 5,434,123 | 7/1995 | Geirhos et al. | 428/399 |
| 5,459,991 | 10/1995 | Nabeshima et al. | 57/290 |
| 5,464,684 | 11/1995 | Vogelsang et al. | 57/244 |
| 5,593,777 | 1/1997 | Jacob et al. | 428/399 |
| 5,654,067 | 8/1997 | Dinger et al. | 428/95 |
| 5,688,594 | 11/1997 | Lichscheidt et al. | 428/370 |
| 5,863,644 | 1/1999 | Bonigk et al. | 428/221 |

FOREIGN PATENT DOCUMENTS

| | | | |
|---|---|---|---|
| 455193 | 11/1991 | European Pat. Off. . | |
| 717133 | 6/1996 | European Pat. Off. . | |
| 737763 | 10/1996 | European Pat. Off. . | |
| 3130427 | 6/1991 | Japan | 57/351 |
| 153927 | 6/1978 | United Kingdom . | |

OTHER PUBLICATIONS

Chemiefasern/Textilindustrie, (7/8), 1989, T 185–7.

*Primary Examiner*—William Stryjewski
*Attorney, Agent, or Firm*—Connolly Bove Lodge & Hutz

[57] ABSTRACT

The low-shrinkage hybrid yarns comprise reinforcing filaments and matrix filaments composed of thermoplastic polymers having a lower melting point than the melting or decomposition point of the reinforcing filaments. The yarns are characterized by a 160° C. hot air shrinkage of not more than 2% and a 200° C. hot air shrinkage of not more than 5%. A process for producing these hybrid yarns includes the steps of feeding yarn strands moving at different speeds into an entangling jet, heating a matrix feed yarn during the feeding thereof into the entangling jet, entangling the feed yarn strands, and taking off the strands with or without shrinkage and additional heating.

3 Claims, 1 Drawing Sheet

LOW-SHRINKAGE HYBRID YARNS PRODUCTION THEREOF AND USE THEREOF

CROSS-REFERENCE TO RELATED APPLICATION

This is a divisional of application Ser. No. 08/835,262, filed Apr. 8, 1997, now U.S. Pat. No. 5,879,800.

The present invention relates to novel hybrid yarns having a particularly low hot air shrinkage. Such yarns are advantageously useful for processing into composites or into textile sheet materials, such as laid structures.

Hybrid yarns, i.e. yarns composed of reinforcing and matrix filaments, are known per se. Such yarns are for example intermediates for producing composites. To this end, it is customary to produce initially a textile sheet material from the hybrid yarn; the matrix filaments of these hybrid yarns are then melted incipiently or completely to form a matrix which embeds or surrounds the reinforcing filaments to form the composite.

Matrix filaments generally do not have to meet high requirements as regards strength and other mechanical properties, since they are in any case melted in later processing steps. Thus, the production of such filaments does not include an elaborate aftertreatment after spinning, such as drawing or setting. Matrix filaments therefore inherently possess appreciable hot air shrinkage, which can have adverse effects on the product in the later processing steps.

There is a need for hybrid yarns with low shrinkage. Such yarns naturally only shrink to a very small extent, if at all, during the heating to form the matrix. Consequently, the position of the reinforcing filaments is only interfered with insignificantly, if at all, during the production of the matrix. Moreover, these novel yarns significantly simplify the production of laid structures. Hitherto elaborate measures had to be taken during the setting of the superposed yarns in the production of the laid structure to absorb the shrinkage of the yarns released by the heating and to stabilize the primary laid structure. The novel hybrid yarns substantially obviate these measures.

It is true that two-component loop yarns of high strength and low shrinkage are known. Such yarns were developed especially for use as sewing threads and described for example in EP-B-363,798. Such yarns, however, customarily do not comprise matrix filaments composed of lower melting filaments, but are constructed of filaments of one type but different strengths, which are arranged in a core-sheath structure.

DETAILED DESCRIPTION OF THE INVENTION

Figures 1A, 1B, 1C, 1D:
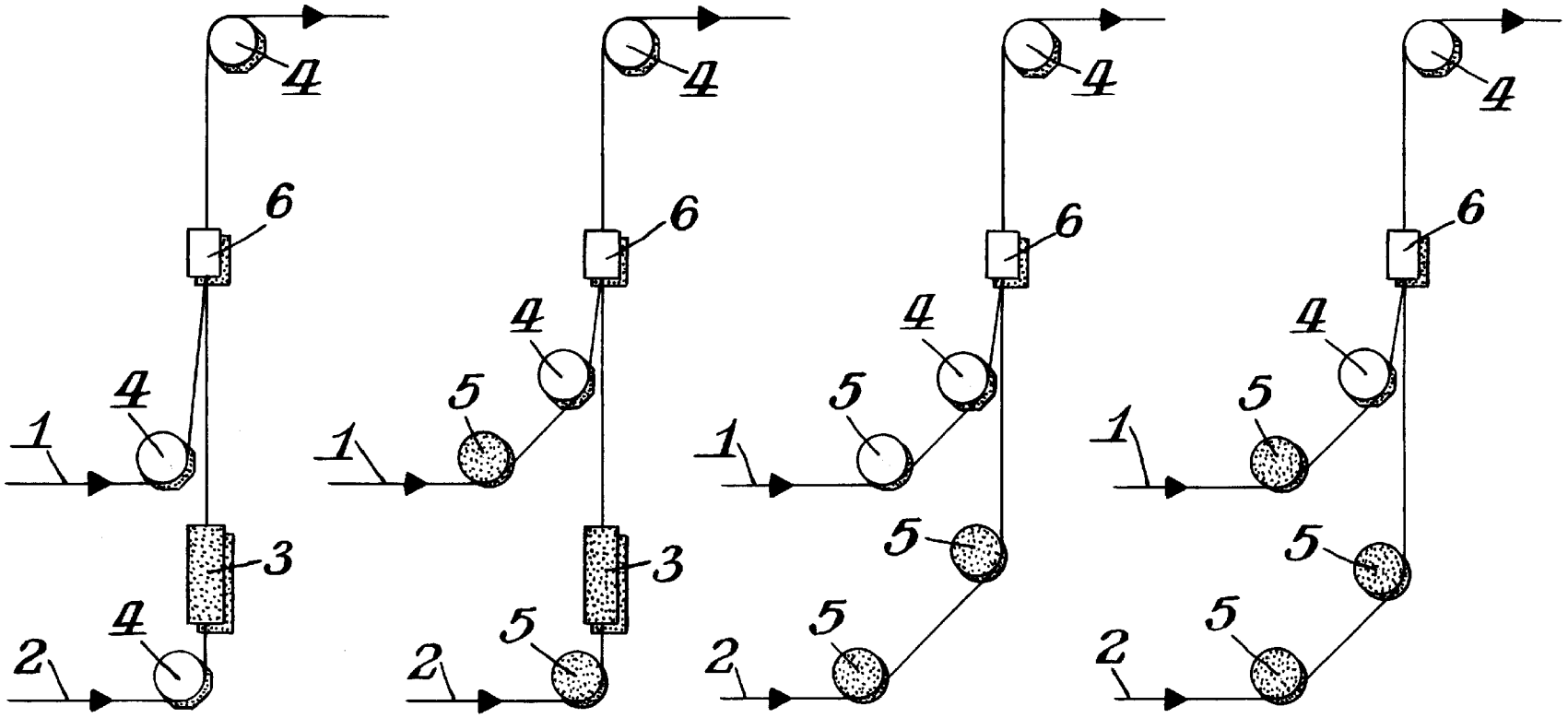
FIGS. 1*a* to 1*d* shows alternative processes for low-shrinkage hybrid yarn manufacturing.

A process has now been found for producing low-shrinkage hybrid yarns having the above-described property profile. The yarns of the invention are characterized by very low hot air shrinkage over a relatively wide temperature range.

FIGS. 1*a* to 1*d* show the alternative arrangements of the process for producing a low-shrinkage hybrid yarn. A reinforcing feed yarn 1 and matrix yarn 2 are fed through the entangling jet 6 via heated guide roll 5, unheated guide rolls 5 and heater 3.

The present invention accordingly provides low-shrinkage hybrid yarns comprising reinforcing filaments and matrix filaments composed of thermoplastic polymers having a lower melting point than the melting or decomposition point of the reinforcing filaments. The hybrid yarns of the invention are characterized by a hot air shrinkage, measured on a yarn sample under a load of 0.0004 cN/dtex, of not more than 2%, especially not more than 1%, at an air temperature of 160° C. and of not more than 5%, especially not more than 3%, at an air temperature of 200° C.

To determine the hot air shrinkage of the hybrid yarns of the invention, loops are formed at both ends of six yarn samples each 60 cm in length and these yarn samples are suspended by their loops from a bar. These yarn samples are each exposed to a pretensioning force of 0.0004 cN/dtex by means of a weight. The bar with the yarn samples is suspended in a through-circulation oven and then treated for 15 minutes with hot air at the defined temperature. The hot air shrinkage is the % change in length of the yarn sample before and after heating.

The mechanical properties of the hybrid yarns of the invention can be varied within wide limits depending on the composition, such as type and proportion of the reinforcing filaments or of the matrix filaments as a function of the physical construction of the yarns, for example degree of entangling. The proportion of the matrix filaments is customarily 5 to 60% by weight, preferably 10 to 50% by weight, based on the weight of the hybrid yarn.

The term "hybrid yarn" is herein to be understood in its widest meaning. It accordingly encompasses any combination comprising reinforcing filaments and the above-defined matrix filaments.

Examples of possible hybrid yarn types are filament yarns composed of various types of filaments which are entangled with one another or combined with one another by means of some other technology, for example twisting. All these hybrid yarns are typified by the presence of two or more types of filaments, at least one filament type being a reinforcing filament and at least one filament type being a matrix filament within the meaning of the above-stated definitions.

Particular preference is given to using hybrid yarns produced by intermingling or commingling techniques; the yarns in question can be loop yarns, but are preferably flat yarns.

The flat yarns of the invention are notable for particularly good processibility by fabric-forming technologies and for good fabric patterns.

The hybrid yarns of the invention preferably have a static shrinkage force, measured according to DIN 53866 Part 12, of up to 0.01 cN/dtex at temperatures of up to 200° C.

To measure the static shrinkage force of a yarn, five samples of it, 60 cm in length, are clamped into two jaws under a pretension of 0.01 cN/dtex. The clamped yarn sample is then treated with air at the desired temperature for one minute. The static shrinkage force is the force in the longitudinal direction of the yarn which arises on heating, and it reaches a saturation value after a short time period.

The number of entanglements in the hybrid yarns of the invention can be varied within wide limits through the choice of the entangling conditions. The higher the proportion of the mechanically relatively labile matrix component, the less intensive the entangling process can be, and consequently the entanglement spacing of such yarns is normally relatively large.

Preferred hybrid yarns have an entanglement spacing of less than 60 mm, preferably less than 30 mm; this value is based on a measurement with the 2050 Rothschild Entanglement Tester, which is based on the pin count principle.

The matrix filaments of the hybrid yarns of the invention consist of thermoplastic polymers. These preferably have a melting point which is at least 30° C. below the melting or decomposition point of the particular reinforcing filaments used.

The reinforcing filaments used in the hybrid yarns of the invention can be filaments composed of a multiplicity of materials. Inorganic materials can be used as well as organic polymers. Reinforcing filaments for the purposes of this invention are filaments which perform a reinforcing function in the contemplated textile sheet material or composite.

In a first preferred embodiment, the reinforcing filaments are constructed of individual filaments having an initial modulus of more than 50 Gpa.

Preferred reinforcing filaments of this type consist of glass; carbon; metals or metal alloys, such as steel, aluminum or tungsten; nonmetals, such as boron; metal, semimetal or nonmetal oxides, carbides or nitrides, such as aluminum oxide, zirconium oxide, boron nitride, boron carbide, silicon carbide, silicon dioxide (quartz); ceramics, or high performance polymers (i.e. fibers which provide a very high initial modulus and a very high breaking strength with little drawing, if any), such as liquid-crystalline polyesters (LCP), poly(bisbenzimidazobenzophenanthroline)s (BBB), poly(amide-imide)s (PAI), polybenzimidazoles (PBI), poly(p-phenylenebenzobisoxazole)s (PBO), poly(p-phenylenebenzobisthiazole)s (PBT), polyether ketones (PEK, PEEK, PEEKK), polyetherimides (PEI), polyether sulfones (PESU), polyimides (PI), poly(p-phenylene)s (PPP), polyarylene sulfides (PPS), polysulfones (PSU), polyolefins, such as polyethylene (PE) or polypropylene (PP), and aramids (HMA), such as poly(m-phenyleneisophthalamide), poly(m-phenyleneterephthalamide), poly(p-phenyleneisophthalamide), poly(p-phenyleneterephthalamide), or aramids which are spinnable from organic solvents, such as N-methylpyrrolidone, and which are derived from terephthaloyl dichloride and a mixture of two or more aromatic diamines, for example the combination of p-phenylenediamine, 1,4-bis(4-aminophenoxy)benzene, 3,3'-dimethylbenzidine, or p-phenylenediamine, 1,4-bis(4-aminophenoxy)benzene, 3,4'-diaminodiphenyl ether, or p-phenylenediamine, m-phenylenediamine, 1,4-bis(4-aminophenoxy)benzene.

Particular preference is given to reinforcing filaments composed of glass, carbon or aromatic polyamide.

In a second particularly preferred embodiment, the reinforcing and matrix filaments used consist of polymeric materials from the same class of polymer, for example of polyolefins, of polyamides or preferably of polyesters.

In this embodiment, the individual filaments of the reinforcing filaments have an initial modulus of more than 10 GPa. Reinforcing filaments for this embodiment are preferably high strength, low shrinkage polyester filament yarns, especially with a yarn linear density of not more than 1100 dtex, a tenacity of not less than 55 cN/tex, an ultimate tensile strength extension of not less than 12% and a 200° C. hot air shrinkage of not more than 9%.

The ultimate tensile strength and the ultimate tensile strength extension of the polyester yarns used are measured on the lines of DIN 53 830 Part 1.

Matrix filaments in the hybrid yarns of the invention consist of or comprise thermoplastic polymers. Any desired melt-spinnable thermoplastic can be used, as long as the filaments produced therefrom melt at a temperature which is lower than the melting or decomposition temperature of the particular reinforcing filaments used.

Preference is given to matrix filaments composed of polybutylene terephthalate and/or of polyethylene terephthalate and/or of chemically modified polyethylene terephthalate.

Very particular preference is given to using matrix filaments composed of a thermoplastic modified polyester, especially a modified polyethylene terephthalate; the modification serves to reduce the melting point compared with the filament composed of unmodified polyester.

Particularly preferred modified polyesters of this type contain the structural repeat units of the formulae I and II $$—O—OC—Ar^1—CO—O—R^1— \quad (I),$$

$$—O—OC—R^2—CO—O—R^3— \quad (II),$$

where $Ar^1$ is a bivalent mono- or polycyclic aromatic radical whose free valences are disposed para or comparably parallel or coaxial to each other, preferably 1,4-phenylene and/or 2,6-naphthalene, $R^1$ and $R^3$ are independently of each other bivalent aliphatic or cycloaliphatic radicals, especially radicals of the formula $—C_nH_{2n}—$, where n is an integer between 2 and 10, especially ethylene, or a radical derived from cyclohexanedimethanol, and $R^2$ is a bivalent aliphatic, cycloaliphatic or mono- or polycyclic aromatic radical whose free valences are disposed meta or comparably angled to each other, preferably 1,3-phenylene.

Very particularly preferred modified polyesters of this type contain 40 to 95 mol % of structural repeat units of the formula I and 60 to 5 mol % of structural repeat units of the formula II where $Ar^1$ is 1,4-phenylene and/or 2,6-naphthalene, $R^1$ and $R^3$ are each ethylene and $R^2$ is 1,3-phenylene.

In a further preferred embodiment, the matrix filaments used consist of or comprise a thermoplastic and elastomeric polymer. This can likewise be any desired melt-spinnable and elastomeric thermoplastic, as long as the filaments produced therefrom melt at a temperature which is lower than the melting or decomposition temperature of the particular reinforcing filaments used.

An "elastomeric polymer" within the meaning of this invention is a polymer whose glass transition temperature is less than 0° C., preferably less than 23° C.

Preferred examples of thermoplastic and elastomeric polymers are elastomeric polyamides, polyolefins, polyesters and polyurethanes. Such polymers are known per se.

Any bivalent aliphatic radicals in the above-defined structural formulae include branched and especially straight-chain alkylene, for example alkylene having two to twenty, preferably two to ten, carbon atoms. Examples of such radicals are 1,2-ethanediyl, 1,3-propanediyl, 1,4-butanediyl, 1,5-pentanediyl, 1,6-hexanediyl and 1,8-octanediyl.

Any bivalent cycloaliphatic radicals in the above-defined structural formulae include groups containing carbocyclic radicals having five to eight, preferably six, ring carbon atoms. Examples of such radicals are 1,4-cyclohexanediyl or the group $—CH_2—C_6H_{10}—CH_2—$.

Any bivalent aromatic radicals in the above-defined structural formulae are mono- or polycyclic aromatic hydrocarbon radicals or heterocyclic aromatic radicals which can be mono- or polycyclic. Heterocyclic aromatic radicals have in particular one or two oxygen, nitrogen or sulfur atoms in the aromatic nucleus.

Polycyclic aromatic radicals can be fused to one another or linked to one another via C—C bonds or via bridging groups, such as —O—, —S—, —CO— or —CO—NH— groups.

The valence bonds of the bivalent aromatic radicals can be disposed para or comparably coaxial or parallel to each other or else meta or comparably angled to each other.

The valence bonds in mutually coaxial or parallel disposition point in opposite directions. An example of coaxial bonds pointing in opposite directions are the 4,4'-biphenylylene bonds. An example of parallel bonds pointing in opposite directions are the naphthalene-1,5 or -2,6 bonds, whereas the naphthalene-1,8 bonds are parallel but point in the same direction.

Examples of preferred bivalent aromatic radicals whose valence bonds are disposed para or comparably coaxial or parallel to each other are monocyclic aromatic radicals having free valences disposed para to each other, especially 1,4-phenylene, or bicyclic fused aromatic radicals having parallel bonds pointing in opposite directions, especially 1,4-, 1,5- and 2,6-naphthylene, or bicyclic aromatic radicals linked via a C—C bond but having coaxial bonds pointing in opposite directions, especially 4,4'-biphenylene.

Examples of preferred bivalent aromatic radicals whose valence bonds are disposed meta or comparably angled to each other are monocyclic aromatic radicals having free valences disposed meta to each other, especially 1,3-phenylene, or bicyclic fused aromatic radicals having bonds angled to each other, especially 1,6- and 2,7-naphthalene, or bicyclic aromatic radicals linked via a C—C bond and having bonds angled to each other, especially 3,4'-biphenylene.

All these aliphatic, cycloaliphatic or aromatic radicals can be substituted by inert groups. These are substituents with no adverse effect on the contemplated application.

Examples of such substituents are alkyl, alkoxy and halogen.

Alkyl is branched and especially straight-chain alkyl, for example alkyl having one to six carbon atoms, especially methyl.

Alkoxy is branched and especially straight-chain alkoxy, for example alkoxy having one to six carbon atoms, especially methoxy.

Halogen is fluorine, bromine or in particular chlorine, for example.

The matrix filaments used in the hybrid yarn of the invention can be composed of thermoplastic polymers which customarily have an intrinsic viscosity of at least 0.5 dl/g, preferably 0.6 to 1.5 dl/g. The intrinsic viscosity is measured in a solution of the thermoplastic polymer in dichloroacetic acid at 25° C.

If the hybrid yarn to be used according to this invention includes reinforcing filaments composed of polyesters, these polyesters customarily have an intrinsic viscosity of at least 0.5 dl/g, preferably 0.6 to 1.5 dl/g. The intrinsic viscosity is measured as described above.

The hybrid yarns of the invention customarily have yarn linear densities of 6,000 to 150 dtex, preferably 4,500 to 150 dtex.

The individual fiber linear densities of the reinforcing filaments and the matrix filaments customarily vary within the range from 2 to 10 dtex, preferably 4 to 8 dtex.

The cross sections of the reinforcing filaments and of the matrix filaments can have any desired shape, for example elliptical, bi- or multilobal, ribbony or preferably round.

The thermoplastic polymers are produced according to conventional processes by polycondensation of the corresponding bifunctional monomer components. Polyesters are customarily produced from dicarboxylic acids or dicarboxylic esters and the corresponding diol components. Such thermoplastic and possibly elastomeric polyesters, polyurethanes, polyamides and polyolefins are already known.

It has further been found that the hybrid yarns of the invention can be produced by means of specific fluid entangling processes.

Fluid entangling is effected by means of a fluid in an entangling jet, for example water or especially by means of a gas which is inert toward the feed yarn strands, especially by means of air, optionally humidified air.

In fluid entangling, it is known to feed the filament material into the fluid jet at a greater speed than its speed of withdrawal therefrom. The extra speed for the feed compared with the withdrawal, expressed in percent of the withdrawal speed, is known as overfeed.

By varying the overfeeds of the feed yarn strands it is possible to produce fluid-entangled loop or flat yarns.

In these processes, the conventional fluid entangling process is modified to the effect that, before the highly shrinkable matrix filaments enter the entangling jet, their shrinkage is partially or completely released by heating. The overfeed of this feed yarn component prior to the heating step thus has to be larger in this process than without such a heating step. Depending on the overfeed chosen for the feed into the entangling jet and on the entangling conditions chosen, it is possible to produce loop hybrid yarns or in particular flat hybrid yarns.

Conventional entangling jets can be used. The entanglement spacing or level is primarily determined by the pressure of the entangling medium and the particular jet type chosen. To obtain a desired entanglement spacing, the appropriate entangling pressure has to be chosen for each jet type. The operating pressure is advantageously within the range from 1 to 8 bar, preferably from 1.5 to 6 bar, in particular from 1.5 to 3 bar.

The invention also provides a process for producing the above-defined low-shrinkage hybrid yarns which comprises the measures of a) feeding two or more feed yarn strands moving at different speeds into an entangling jet, at least a portion of the feed yarn strands (reinforcing feed yarn) consisting of reinforcing filaments and a further portion of the feed yarn strands (matrix feed yarn) consisting of lower melting matrix filaments composed of thermoplastic polymers having a 200° C. hot air shrinkage of more than 20%, b) heating the matrix feed yarn during the feeding into the entangling jet to such a temperature that at least a portion of the shrinkage is released, c) entangling the feed yarn strands in the entangling jet under such conditions that a primary hybrid yarn is formed, and d) taking off the resulting primary hybrid yarn with or without shrinkage and/or additional, preferably contactless heating.

The releasing of the shrinkage of the matrix feed yarn prior to entry into the entangling jet can be effected according to methods known per se. For example by heating by means of godets, by contact with a heating rail or pin, contactlessly by passing through a heating apparatus, for example through an apparatus as described in EP-A-579,082 or by a steam stuffer box process.

As reinforcing feed yarns it is possible either to present the entangling apparatus with multifilament yarns which are already of high tenacity, or the multifilament yarns can be drawn and optionally set immediately before entry into the entangling jet.

Preference is given to using reinforcing feed yarns having an ultimate tensile strength, based on the final linear density, of at least 60 cN/tex.

Further preferred reinforcing feed yarns have a 200° C. hot air shrinkage of 2 to 8%.

Further preferred reinforcing feed yarns have an ultimate tensile strength extension of 0.5 to 25%.

The matrix feed yarns do not have to meet high requirements as regards mechanical properties. They have to survive the entangling step at least.

The primary hybrid yarn emerging from the entangling jet is taken off, which usually has to be effected with low tension at most. Depending on the differences in overfeed between the feed yarns and the entangling conditions in the jet, the primary hybrid yarn formed may exhibit no loops, a small proportion of loops or a high proportion of loops. If a flat yarn is desired, the primary yarn having a small or high proportion of loops can be heated with shrinkage being allowed. The loops contract and the yarn structure is substantially flattened. Flat yarns formed directly within the entangling jet are customarily taken off and wound up directly.

The entangling of the hybrid yarns from reinforcing and matrix filaments of the above-described first embodiment is preferably effected by means of a specific hot entangling process which is described in EP-B-0,455,193. Here, to avoid filament breakages during entangling, the reinforcing filaments are heated up to close to the softening point (about 600° C. in the case of glass) prior to their entangling. The heating can be effected by means of godets and/or heating tube, while the low melting thermoplastic individual filaments composed of polyester are likewise preheated to release the shrinkage and are fed to the superordinate entangling jet. The resulting flat, highly coherent hybrid yarns weave perfectly satisfactorily.

It was found that the production of the hybrid yarns from reinforcing and matrix filaments of the above-described second embodiment can be surprisingly effected according to customary entangling techniques, for example by intermingling or commingling techniques as described for example in Chemiefasern/Textilindustrie, (7/8)1989, T 185-7, modified by the above-described heating step of the matrix feed yarn, however.

The hybrid yarns of the invention can be processed by conventional processes into textile sheet materials. Examples thereof are woven, knit and in particular laid structures. Such textile sheet materials can be converted into composites or stabilized by melting the matrix component.

The invention also provides for the use of the hybrid yarns for these purposes.

The examples which follow illustrate the invention without limiting it.

EXAMPLES

1) Production of low-shrinkage hybrid yarns

A creel was loaded with a bobbin of reinforcing feed yarn and a bobbin of matrix feed yarn. The nature of the feed yarns and the yarn linear densities used are listed in Table 1 below.

The reinforcing feed yarn was fed directly into an entangling jet via a delivery system consisting of three godets. In some runs, a heating apparatus was included between the delivery godets. This heating apparatus was an apparatus for heating moving yarns contactlessly, as described in EP-A-579,082.

The matrix feed yarn was likewise fed into the texturing jet via a delivery system consisting of two godets and a heating apparatus arranged in between. Instead of or in addition to the heating apparatus, the delivery godets were heated. The heating apparatus was an apparatus for heating moving yarns contactlessly, as described in EP-A-579,092.

The ratio of the overfeed upstream of the entangling jet and the downstream takeoff system for the reinforcing feed yarns and for the matrix feed yarns are likewise indicated in the below-recited table.

The temperatures of the godets of the delivery systems ranged selectively between 80 and 130° C.

The primary hybrid yarn emerging from the entangling jet was taken off by means of a further godet whose surface speed was controlled so as to optimize the yarn structure in respect of the textile performance characteristics. Details concerning the practice of the process are found in the table which follows.

A further Table 2 shows the properties of the resulting hybrid yarns.

TABLE 1

| | | Production conditions of hybrid yarns | | | | |
|---|---|---|---|---|---|---|
| | | | Overfeed | | Heater/godet temperature | Heater/godet temperature |
| Example No. | Reinforcing feed yarn (Type: dtex) | Matrix feed yarn (Type: dtex) | Reinf. feed yarn | Matrix feed yarn (%) | Reinforcing feed yarn (° C.) | Matrix feed yarn (° C.) |
| 1 | PET 1100 | mod. PET 280 | — | 60 | — | 110 (god) |
| 2 | PET 550 | mod. PET 280 | — | 30 | — | 110 (god) |
| 3 | Glass 3000 | mod. PET 840 | — | 30 | 500 | 110 (god) |
| 4 | Glass 3000 | mod. PET 840 | — | 10 | — | 160 |
| 5 | Glass 3000 | mod. PET 830 | — | 30 | 500 | 110 (god) |
| 6 | Glass 3000 | mod. PET 750 | — | 60 | 500 | 210 60 (god) |

TABLE 1-continued

| Production conditions of hybrid yarns | | | | | | |
|---|---|---|---|---|---|---|
| | | | Overfeed | | Heater/godet temperature | Heater/godet temperature |
| Example No. | Reinforcing feed yarn (Type: dtex) | Matrix feed yarn (Type: dtex) | Reinf. feed yarn | Matrix feed yarn (%) | Reinforcing feed yarn (° C.) | Matrix feed yarn (° C.) |
| 7 | Aramid 1100 | mod. PET 280 | — | 50 | 100 (god) | 110 (god) |
| 8 | Carbon fiber 3000 | mod. PET 840 | — | 50 | 110 (god) | 110 (god) |

PET = polyethylene terephthalate
mod. PET = isophthalic acid modified PET

TABLE 2

| Properties of hybrid yarns | | | | | |
|---|---|---|---|---|---|
| Example No. | Eff. linear density (dtex) | Strength (cN/tex) | Extension (%) | Shrinkage at 200° C. | Shrinkage at 160° C. |
| 1 | 1600 | 50.2 | 18.1 | 3.5 | 1.1 |
| 2 | 930 | 37.9 | 21.8 | 3.9 | 1.0 |
| 3 | 4067 | 45.9 | 0.7 | 0 | 0 |
| 4 | 3880 | 46.5 | 0.8 | 0 | 0 |
| 5 | 4180 | 36.7 | 0.8 | 0.5 | 0 |
| 6 | 4590 | 39.8 | 0.8 | 3.1 | 0.6 |
| 7 | 1583 | 124.6 | 3.6 | 0.3 | 0 |
| 8 | 3219 | 56.1 | 1.3 | 0.1 | 0 |

2) Production of low-shrinkage hybrid yarns (variation of matrix feed yarn overfeed)

Hybrid yarns were produced by entangling as described in Example 1. The reinforcing feed yarns used were 1100 dtex high tenacity PET multifilament yarns and the matrix feed yarns used were 280 dtex filament yarns based on isophthalic acid modified PET. Details of the production conditions are listed in Table 3. The properties of the resulting yarns are shown in Table 4.

TABLE 3

| Production conditions of hybrid yarns | | | | |
|---|---|---|---|---|
| | Overfeed | | Heater/godet temperature Reinforcing | Heater/godet temperature Matrix |
| Example No. | Reinforcing feed yarn | Matrix feed yarn | feed yarn (° C.) | feed yarn (° C.) |
| 9 | — | — | — | — |
| 10 | — | 10% | 100 (god) | 110 (god) |

TABLE 3-continued

| Production conditions of hybrid yarns | | | | |
|---|---|---|---|---|
| | Overfeed | | Heater/godet temperature Reinforcing | Heater/godet temperature Matrix |
| Example No. | Reinforcing feed yarn | Matrix feed yarn | feed yarn (° C.) | feed yarn (° C.) |
| 11 | — | 20% | 100 (god) | 110 (god) |
| 12 | — | 30% | 100 (god) | 110 (god) |
| 13 | — | 40% | 100 (god) | 110 (god) |
| 14 | — | 50% | 100 (god) | 110 (god) |
| 15 | — | 60% | 100 (god) | 110 (god) |

TABLE 4

| Properties of hybrid yarns | | | | | |
|---|---|---|---|---|---|
| Example No. | Eff. linear density (dtex) | Strength (cN/tex) | Extension (%) | Shrinkage at 200° C. | Shrinkage at 160° C. |
| 9 | 1430 | 56.4 | 18.9 | 8.9 | 7 |
| 10 | 1455 | 55.8 | 18.0 | 5.4 | 1.9 |
| 11 | 1483 | 55.3 | 18.1 | 4.4 | 1.5 |
| 12 | 1517 | 53.7 | 18.2 | 4.2 | 1.4 |

TABLE 4-continued

| Properties of hybrid yarns | | | | | |
|---|---|---|---|---|---|
| Example No. | Eff. linear density (dtex) | Strength (cN/tex) | Extension (%) | Shrinkage at 200° C. | Shrinkage at 160° C. |
| 13 | 1537 | 53.5 | 18.6 | 3.9 | 0.6 |
| 14 | 1577 | 50.5 | 17.9 | 3.7 | 1.1 |
| 15 | 1600 | 50.2 | 18.1 | 3.5 | 1.1 |

These examples show that the shrinkage of the entangled yarn decreases with increasing matrix feed yarn overfeed.

3) Production of low-shrinkage hybrid yarns (variation of overfeed and heating of matrix feed yarn)

Hybrid yarns were produced by entangling as described in Example 1. The reinforcing feed yarns used were 3000 dtex glass multifilament yarns and the matrix feed yarns used were 750 dtex filament yarns based on isophthalic acid modified PET. Details of the production conditions are listed in Table 5. Properties of the resulting yarns are shown in Table 6.

TABLE 5

| Production conditions of hybrid yarns | | | | |
|---|---|---|---|---|
| | Overfeed | | Heater/godet temperature Reinforcing | Heater/godet temperature Matrix |
| Example No. | Reinforcing feed yarn | Matrix feed yarn | feed yarn (° C.) | feed yarn (° C.) |
| 16 | — | — | — | 210 |
| 17 | — | 10% | — | 210 |
| 18 | — | 20% | — | 210 |
| 19 | — | 30% | — | 210 |
| 20 | — | 40% | — | 210 |
| 21 | — | 50% | — | 210 + 60 (god) |
| 22 | — | 60% | — | 210 + 60 (god) |

TABLE 6

| Properties of the hybrid yarns | | | | | |
|---|---|---|---|---|---|
| Example No. | Eff. linear density (dtex) | Strength (cN/tex) | Extension (%) | Shrinkage at 200° C. | Shrinkage at 160° C. |
| 16 | 4181 | 36.1 | 1.1 | 65.5 | n.d. |
| 17 | 4250 | 34.4 | 0.7 | 33.4 | n.d. |
| 18 | 4310 | 28.7 | 0.9 | 29.5 | n.d. |
| 19 | 4380 | 27.5 | 0.7 | 25.1 | n.d. |
| 20 | 4450 | 29.3 | 1.1 | 18.8 | n.d. |
| 21 | 4515 | 30.8 | 1.3 | 7.5 | 3.8 |
| 22 | 4590 | 39.8 | 0.8 | 3.1 | 0.9 |

n.d. = not determined

These examples show that the shrinkage of the entangled yarn decreases on increasing the overfeed and the heating of the matrix feed yarn.

4) Determination of shrinkage of a hybrid yarn under different pretensioning forces A low-shrinkage hybrid yarn having a reinforcing feed yarn composed of PET and a matrix feed yarn composed of isophthalic acid modified PET was produced similarly to the above-described examples. The yarn linear density was 1380 dtex. This yarn was weighted with different pretensioning weights and in each case treated for 15 minutes in a through-circulation oven at an air temperature of 100° C. or 160° C. The following hot air shrinkage values were measured:

| | | | | | |
|---|---|---|---|---|---|
| Pretensioning weight (cN) | 0.16 | 0.5 | 0.8 | 1.5 | 3 |
| Hot air shrinkage at 100° C. | 33.5 | 2.3 | 1 | 0.5 | 0.5 |
| Hot air shrinkage at 160° C. | 0.4 | 0.3 | 0.3 | 0.2 | 0.1 |

5) Determination of the entanglement spacing of hybrid yarn having different proportions of matrix component Various low-shrinkage hybrid yarns having reinforcing feed yarn composed of high tenacity PET and a matrix feed yarn composed of isophthalic acid modified PET were produced similarly to the above-described examples. The yarns differed in the quantitative proportion of the matrix component and in the entanglement level. The entanglement spacing was determined by means of a Rothschild Entanglement Tester. The following values were measured:

| | | | | | | | | | | |
|---|---|---|---|---|---|---|---|---|---|---|
| Volume % of matrix in hybrid yarn | 90 | 90 | 80 | 80 | 70 | 70 | 60 | 60 | 50 | 50 |
| Strongly entangled | + | − | + | − | + | − | + | − | + | − |
| Lightly entangled | − | + | − | + | − | + | − | + | − | + |
| Entanglement spacing (mm) | 57 | 101 | 41 | 87 | 32 | 70 | 28 | 59 | 19 | 51 |

6) Characterization of properties of hybrid yarns having matrix components with different melting points Low-shrinkage hybrid yarns were produced from reinforcing feed yarn composed of PET and matrix feed yarn composed of different isophthalic acid modified PET types similarly to the above-described examples. The production conditions were the same in each case. The matrix feed yarns differed in the melting range of the PET type. The proportion of the matrix component in the hybrid yarns was 15 to 20% by volume in each case. The overfeed of the matrix feed yarn varied between 50 and 100%. Some properties of the resulting hybrid yarns are listed in the following table:

| Hybrid yarn sample | A | B | C |
|---|---|---|---|
| Melting range of mod. PET component (° C.) | ca. 130 | ca. 170 | ca. 225 |
| Yarn linear density (dtex) | 1330 | 1313 | 1558 |
| 160° C. hot air shrinkage | 0.7 | 0.9 | 0.9 |
| 200° C. hot air shrinkage | 1.3 | 1.8 | 1.9 |
| Ultimate tensile strength extension (%) | 16 | 16.5 | 15.8 |
| Ultimate tensile strength (cN/tex) | 51 | 52.5 | 48.8 |

It is clear that it is possible to produce hybrid yarns having different melting ranges for the matrix component but similar mechanical properties.

What is claimed is:

1. A process for producing a low-shrinkage hybrid yarn which comprises the measures of a) feeding two or more feed yarn strands moving at different speeds into an entangling jet, at least a portion of the feed yarn strands forming a reinforcing feed yarn consisting of reinforcing filaments and a further portion of the feed yarn strands forming a matrix feed yarn consisting of matrix filaments composed of thermoplastic polymers having a 200° C. hot air shrinkage of more than 20% and a melting point which is at least 30° C. below the melting point of the reinforcing filaments, b) heating the matrix feed yarn during the feeding into the entangling jet to such a temperature that the shrinkage or at least a portion of the shrinkage is released, c) entangling the reinforcing feed yarn and the matrix feed yarn in the entangling jet under such conditions that a primary hybrid yarn is formed, and d) taking off the resulting primary hybrid yarn with or without shrinkage and additional heating.

2. The process of claim 1, wherein the differences in the overfeed of the feed yarns entering the entangling jet are chosen in a range of 10 to 60% so that the resulting entangled yarn is a flat hybrid yarn.

3. The process of claim 1, wherein the differences in the overfeed of the feed yarns entering the entangling jet are chosen so that the resulting entangled yarn is a loop hybrid yarn whose loops are substantially flattened out again through release of the shrinkage in one or more successive heating stages after the entangling step.

* * * * *